US006200440B1

(12) United States Patent
Moran et al.

(10) Patent No.: US 6,200,440 B1
(45) Date of Patent: Mar. 13, 2001

(54) ELECTROLYSIS CELL AND ELECTRODES

(75) Inventors: Stephen W. Moran, Wilmington; Timothy J. Gallivan, Hampstead; John R. Jackson; Sam A. Pirapakaran, both of Wilmington, all of NC (US)

(73) Assignee: Huron Tech Corp, Delco, NC (US)

( * ) Notice: Subject to any disclaimer, the term of this patent is extended or adjusted under 35 U.S.C. 154(b) by 0 days.

(21) Appl. No.: 09/044,364

(22) Filed: Mar. 19, 1998

Related U.S. Application Data

(63) Continuation of application No. 08/552,938, filed on Nov. 3, 1995, now abandoned.

(51) Int. Cl.[7] ..... C25B 11/08

(52) U.S. Cl. ..... 204/290.01; 204/290.12; 204/290.14

(58) Field of Search ..... 204/290 R, 290 F, 204/290.01, 290.12, 290.14

(56) References Cited

U.S. PATENT DOCUMENTS

| | | | | |
|---|---|---|---|---|
| 3,632,498 | | 1/1972 | Beer | 204/290 F |
| 3,884,778 | | 5/1975 | Eng et al. | 204/84 |
| 4,620,915 | * | 11/1986 | Ohlin | 204/290 R |
| 4,941,961 | | 7/1990 | Noguchi et al. | 204/294 |
| 5,082,543 | | 1/1992 | Gnann et al. | 204/255 |
| 5,300,206 | | 4/1994 | Allen et al. | 204/284 |
| 5,413,689 | | 5/1995 | de Nora et al. | 204/279 |
| 5,681,445 | | 10/1997 | Harrison et al. | 204/445 |

* cited by examiner

*Primary Examiner*—Arun S. Phasge
(74) *Attorney, Agent, or Firm*—Andrew E. Pierce

(57) ABSTRACT

Peroxydisulfuric acid and salts thereof are produced electrochemically from an aqueous acid sulfate solution in a cascading series of bipolar electrolytic cells having a cell body frames of polyvinyl chloride which are bonded with a vinyl ester polymer. An aqueous solution of peroxydisulfuric acid and salts thereof are withdrawn from the anode compartment of the last cell in the series, and metal impurities are removed by treatment with an ion exchange resin. Hydrogen peroxide is produced by hydrolyzing persulfuric acid and salts thereof. The sulfuric acid produced is recycled to the first cell in the series of cascading electrolytic cells.

7 Claims, No Drawings

ELECTROLYSIS CELL AND ELECTRODES

This application is a continuation of Ser. No. 08/552,938 filed Nov. 3, 1995 now abandoned.

BACKGROUND OF THE INVENTION

1. Field of the Invention

This invention relates to a novel electrolytic cell and bipolar electrodes for producing peroxydisulfuric acid and peroxydisulfates and a closed loop process for the production of hydrogen peroxide by hydrolysis of said peroxydisulfuric acid and peroxydisulfates.

2. Description of Related Prior Art

Inorganic persulfate compounds are very strong oxidants used mainly in textile bleaching, metal cleaning, and etching solutions as well as emulsion polymerization initiators. The only commercial method of preparation for a persulfate compound such as peroxydisulfuric acid (persulfuric acid) and salts thereof (persulfates) is an electrochemical process with platinum being commonly used as the anode material. The state of the art with respect to the commercial production of peroxydisulfates has been reviewed in an article entitled *Electrochemical Reactors* by Balej et al. appearing in Fortschritte Der Verfahrenstechnik (Progress in Chemical Engineering) section D, 22 (1984) pages 361–389. This article also reviews the state of the art with respect to the commercial production of hydrogen peroxide by the hydrolysis of peroxydisulfate. Hydrogen peroxide can be produced from ammonium bisulfate by electrolysis with 80 to 90 percent current efficiency in accordance with the following reaction.

$$2NH_4HSO_4 \xrightarrow[\text{Current}]{\text{Direct}} (NH_4)_2S_2O_8 + H_2 \quad \text{(I)}$$

$$(NH_4)_2S_2O_8+2H_2O \rightarrow 2NH_4HSO_4+H_2O_2 \quad \text{(II)}$$

Hydrogen peroxides can also be produced by the electrolysis of a sulfuric acid solution in a series of electrolytic cells, preferably arranged so that the electrolyte solution cascades from one cell to the next by gravity. The persulfuric acid or ammonium persulfate derived from the electrolysis can be hydrolyzed by passing it continuously through a steam jacketed coil in which the liquid is evaporated to about ½ its original volume and the peroxydisulfuric acid and persulfate are hydrolyzed to produce hydrogen peroxide as vapor. The evaporation of water increases the acid concentration of the electrolyte containing peroxydisulfuric acid thereby accelerating the rate of hydrolysis to produce hydrogen peroxide. The overall reaction for producing persulfuric acid by electrolysis from sulfuric acid and the subsequent reaction outside the cell of the persulfuric acid to produce hydrogen peroxide in the hydrolyzer are:

In the cell:

$$2H_2SO_4 \rightarrow H_2S_2O_8+H_2 \quad \text{(III)}$$

and in the hydrolyzer:

$$H_2S_2O_8+H_2O \rightarrow 2H_2SO_4+H_2O_2 \quad \text{(IV)}$$

Other processes for the production of hydrogen peroxide are disclosed in:

| | |
|---|---|
| U.S. 2,745,719 | U.S. 2,178,496 |
| U.S. 2,163,898 | U.S. 2,169,128 |
| U.S. 2,278,605 | U.S. 2,091,218 |
| U.S. 2,243,810 | |

Most of the hydrogen peroxide produced on an industrial scale is prepared by the oxidation of alkylhydroanthraquinones in view of the very high energy consumption of electrolytic processes for the production of persulfuric acid or salts thereof and the concentration and hydrolysis of the product of the electrolytic process to produce hydrogen peroxide. More recent work to improve the efficiency of producing persulfuric acid or persulfate salts by electrolysis and the subsequent concentration and hydrolysis to produce hydrogen peroxide are disclosed in the following patents:

| | |
|---|---|
| U.S. 2,282,184 | U.S. 4,802,959 |
| U.S. 3,884,778 | U.S. 3,694,154 |

In U.S. Pat. No. 4,802,959, a glassy carbon anode is disclosed as a low cost alternative to platinum for use in an electrolytic cell for the production of peroxydisulfuric acid and its salts. In U.S. Pat. No. 3,884,778, an electrolytic cell having three compartments is utilized to prepare peroxydisulfuric acids and sulfuric acid in one compartment of the cell and an alkali metal hydroxide in another compartment of the cell. Hydrolysis of the peroxydisulfuric acid outside the cell is used to produce hydrogen peroxide.

In U.S. Pat. No. 5,082,543, an electrolysis cell of the filter press type is disclosed for the production of peroxy and perhalogenate compounds including peroxydisulfates and peroxydisulfuric acid. Platinum coated valve metal substrates are disclosed as anodes, the platinum layer being applied to the substrates by hot isostatic pressing, or diffusion welding, of a platinum foil onto the valve metal substrate. Preferably, the platinum foil has a thickness of about 20 to about 100 microns. The cathode used in the electrolytic cell is a perforated, liquid and gas permeable cathode of stainless steel which is further identified as tool steel number 1.4539. Electrolysis cell separators are cation exchange membranes such as Nafion® 423. These are clamped between the frames of the cell and the frames are sealed by gaskets of a vinylidene fluoride-hexafluoropropylene copolymer.

SUMMARY OF THE INVENTION

In accordance with the invention, an electrolytic cell is disclosed for the production of peroxydisulfuric acid or salts thereof utilizing a high overvoltage anode comprising a valve metal substrate and a discontinuous coating of a platinum group metal. A stainless steel cathode is used having substantially higher concentrations of nickel, chromium, and molybdenum in comparison with 316 stainless steel. The novel electrolytic cell is of the filter press type having frames of polyvinyl chloride bonded with a vinyl ester polymer. Where the electrolytic cell is utilized in a bipolar electrode configuration, the anode and cathode current collectors are bonded utilizing a vinyl ester polymer containing a substantial proportion of graphite to render the mixture electrically conductive. The electrolytic cell can be operated utilizing a permselective membrane between the anode and cathode but, preferably, a microporous polyvinyl chloride diaphragm is utilized.

For the production of peroxysulfuric acid or salts thereof and for the production of hydrogen peroxide by the subsequent concentration and hydrolysis outside the cell of peroxydisulfuric acid and salts thereof, the filter press cells can be arranged in a series of cascading cells in which the electrolyte is led by gravity from one cell to the next and the catholyte from the last cell in the series is recycled to the anolyte compartment of the first cell of the series so as to constitute a closed loop system. A feature of the novel electrolytic filter press cells disclosed is the use of a metal impurity removal step in which ion exchange resins or other means are used as a means of removing from the electrolyte the metal impurities which accumulate during operation of the cells. If allowed to remain in the peroxydisulfuric acid or salt thereof anolyte product withdrawn for further processing to concentrate and to hydrolyze the product to produce hydrogen peroxide, these metals would act as catalysts for the decomposition of the hydrogen peroxide produced by hydrolysis.

When the novel electrolytic cell is utilized to produce peroxydisulfuric acid and salts thereof for use as reactants in the production of hydrogen peroxide, the use of a metal purification step allows the process to be a closed loop process. The process is environmentally desirable over prior art processes which require periodic purging and disposal to the environment of process streams to remove metal impurities. When the reactants fed to the anode compartment of the electrolytic cells are sulfuric acid and ammonium sulfate, a closed loop process is permitted with the bottoms from the hydrolyzer consisting of sulfuric acid being recycled to the anode compartment of the electrolytic cells as the hydrogen peroxide is removed in the overheads from the hydrolyzer.

DESCRIPTION OF THE PREFERRED EMBODIMENTS

In the filter press type electrolysis cell described in U.S. Pat. No. 5,082,543, hollow cathodes and anodes are disclosed wherein the cathode hollow bodies are liquid and gas permeable and the anode hollow bodies have, above and below a platinum layer, openings for the introduction and removal of the anolyte. The effective anode surface is formed by the platinum layer of a composite anode comprising a valve metal substrate and a platinum layer present thereon which is obtainable by the hot isostatic pressing of a platinum foil onto a valve metal substrate. The cells of this reference are disclosed as useful for the production of peroxy and compounds, specifically, the anodic production of peroxydisulfate, peroxomono sulfates, peroxydiphosphates. By providing circulation of cooling water in the anode, the electrolysis operation is disclosed as being able to proceed with current densities of up to 15 $kA/m^2$ by reducing ohmic voltage losses caused by heating of the anode surface.

As noted above, the '543 patent discloses an electrolysis cell having an anode hollow body and a cathode hollow body through which cooling water circulates in order to dissipate heat formed, particularly, in the anodic production of peroxydisulfates and salts thereof. Because such a cell design in which hollow electrodes are used is fraught with the danger of leakage of the cooling water into the cell electrolyte and, accordingly, requires effective, dependable sealing so as to avoid such leakage, with the possibility of precipitation of one or more electrolysis products within the cell, such a cell design has been intentionally avoided in favor of the use of external heat exchangers in the process of the invention.

The Applicants have found it unnecessary to provide the complexity of electrodes disclosed in '543 in order to operate the electrolytic cell at a high current density on the anode in the production of peroxydisulfuric acid and salts thereof. Accordingly, the possibility of cooling water leakage into the electrolyte is avoided in the electrolytic cells disclosed by the Applicants in which the electrodes are arranged in a planar configuration in a filter press type electrolytic cell with the anode being formed of a valve metal substrate such as titanium, niobium, or zirconium, preferably, titanium, coated with strips of a platinum group metal, preferably, a platinum foil wherein the width of the foil strips is about two times the distance between the strips. The platinum strips are cold rolled onto the valve metal substrate so as to produce a durable anode material which is capable of operating at the high overvoltage conditions necessary to the production of peroxydisulfuric acid and salts thereof. The use of titanium as an anode substrate in the inventive electrolytic cell in the presence of sulfuric acid, which has a reducing effect on the titanium, is made possible by the application of an anodic cell potential which makes the anode environment oxidizing.

The novel cathode utilized in the electrolytic cell of the invention is a mesh or expanded metal planar sheet of a stainless steel having higher concentrations of nickel, chromium, and molybdenum than the 316 stainless steel which has been used as a cathode in electrolytic cells for production of peroxydisulfuric acids and salts thereof. Specifically, the stainless steel cathode comprises in parts by weight about 20 to about 30 parts of nickel, about 15 to about 25 parts of chromium, and about 5 to about 7 parts of molybdenum. A typical composition in weight percent of stainless steels which are suitable as cathodes in the electrolytic cell of the invention is given in Table I in comparison with 316 stainless steel.

TABLE I

| | Stainless Steel components, weight percent. | | |
|---|---|---|---|
| Metal | Stainless Steel A | Stainless Steel B | ANSI 316 |
| Nickel | 24.0 | 25.0 | 12.0 |
| Chromium | 20.5 | 20.0 | 17.0 |
| Molybdenum | 6.3 | 6.5 | 2.5 |
| Silicon | 0.4 | 0.5 | 1.0 |
| Manganese | 0.4 | 1.0 | 2.0 |
| Iron | 48.0 | 47.0 | 67.0 |

The electrolytic cells of the invention can have electrodes arranged in either monopolar or bipolar configuration. Preferably, the electrolytic cells have a bipolar electrode configuration since, given the relatively high cost of the electrode materials, the use of thin planar sheets of electrode material allow the economical use of such high cost electrode materials. In addition, with a bipolar electrode configuration, the multiple electrical connections and multiple seals required at the monopolar electrode leads through a cell wall are avoided. In addition, since electrolytic cells for the production of peroxydisulfate and salts thereof require a relatively high current density at the anode of the cell, even a slightly higher electrode material resistivity can lead to severe heat generation at a monopolar connection. In contrast, with a bipolar electrode, such current distribution problems are avoided which result from the resistivity of the electrode. While the bipolar electrode configuration is less desirable from a current leakage point of view as compared with a monopolar electrode configuration, the use of small inter-cellular flow channels for electrolyte so as to reduce the current leakage and the use of larger electrolyte flow channels to aide in the distribution of electrolyte and for heat removal must be balanced. In a bipolar electrode configuration having a valve metal anode substrate coated with a discontinuous coating of a platinum group metal, preferably platinum, the valve metal anode substrate is subject to exposure to hydrogen produced at the cathode of the cell. The hydrogen can migrate as atomic hydrogen through the bipolar cathode toward the valve metal anode substrate. Prior art bipolar cell configurations have suffered from the formation of a metal hydride at the junction of a valve metal anode and cathode of a bipolar electrode. While the hydride thus formed is a conductive material, the resistance of the hydride is greater than the resistance of the anode and cathode electrodes but, most importantly, because the hydride has a lower density than that of the pure metal from which the anode substrate and the cathode are formed, mechanical stresses can build up large enough to cause failure of the bipolar connection.

In the electrolytic cell of the invention, the possibility of hydride formation and the likelihood of failure of the junction of the anode and cathode in the bipolar electrode configuration has been avoided by the use of a conductive vinyl ester polymer adhesive, which resists hydrogen migration, to join the anode and cathode to form the bipolar electrode.

The vinyl ester polymer utilized is an elastomer modified vinyl ester polymer which is superior to the polyesters utilized in most conventional polyester resin applications. The vinyl ester polymer selected as a component of the conductive adhesive used to join the anode and the cathode of the bipolar electrode configuration is made more flexible and ductile by reacting an elastomer onto the vinyl polymer backbone of the resin. This provides increased adhesive strength, superior resistance to abrasion and mechanical stress and double or triple the toughness performance of standard vinyl ester polymers. As with more conventional vinyl ester polymers the elastomer modified vinyl ester polymer can be reacted with peroxides such as methyl ethyl ketone peroxide and benzoyl peroxide to cure the resin so that it becomes resistant to the highly acid electrolyte. In order to provide the necessary conductivity, the vinyl ester polymer is mixed with a graphite powder in the proportion of about 20 to about 60 percent by weight of the total composition. Preferably, about 30 to about 50 percent of a graphite powder having a particle size of about 10 microns is mixed with about 70 to about 50 percent by weight of the vinyl ester polymer to form the electrically conductive adhesive composition used to bond the anode and cathode of the bipolar electrode. More specifically, it is the anode and cathode current collectors of the electrolytic cell which are bonded together while the anode and cathode are spot welded by spacer posts to the respective current collectors. This allows the adjustment of the anode and cathode gap between the cell separator by selection of spacer post length.

While the sealing of the cells of the filter press configuration assembly of electrolytic cells can be accomplished by O-rings or flat gaskets between the cells and between the multiple frame components making up each individual cell, it has been found advantageous to assemble the cell utilizing the vinyl ester polymer described above in which the adherent toughness of conventional vinyl esters have been enhanced by reacting an elastomer onto the backbone of the vinyl resin. Improved bond strength can be obtained by mechanical or chemical abrasion or etching of the cell frame surfaces to be joined. Sandblasting or organic solvent etching have proven effective to prepare the surface for bonding. It has been found that this vinyl ester resin is superior to the use of an epoxy resin which has been conventionally used in filter press type electrolytic cell construction as a sealing material. This adhesive can also be used to bond individual cell units together to make up the assembled filter press configuration. Alternatively, individual cells can have gaskets joining other cells in the series utilizing conventional gasketing material such as O-rings or flat gaskets of an elastomeric material such as a silicone or fluorine rubber.

The filter press type electrolytic cell configuration of the invention can be used for the production of peroxydisulfates and salts thereof in a closed loop system. The electrolyte of each cell is led to the adjacent cell by arranging the cells in a cascading series so as to utilize gravitational force to move the electrolyte between cells. The catholyte in the last cell of the series is recycled to the anode compartment of the first cell in the series and the peroxydisulfate or salt thereof is removed from the anode compartment of the last cell in the series. Additional reactants are provided to the anolyte compartment of the first cell of the series to make up for the removal of the desired product in the last cell in the series.

When a filter press type electrolysis cell series is utilized in the production of peroxydisulfates and salts thereof which are concentrated and hydrolyzed to produce hydrogen peroxide, a closed loop process can also be provided. In the hydrolysis of the peroxydisulfuric acid or peroxydisulfates to produce hydrogen peroxide, which is removed from the process, the bottoms from the distillation column comprising sulfuric acid can be passed back to the cathode compartment of the electrolysis cell. Such a closed loop process is possible because the process stream leaving the last cell in the series of filter press type electrolysis cells arranged in a cascading series is passed to a metal impurity removal stage of the process in which the process stream is treated to remove impurity metals. Preferably, the process stream exiting the last cell in the cell series is passed through at least one ion exchange resin prior to passing the process stream back to the anode compartment of the first cell in the series. It is essential to remove the impurity metals which accumulate in the process stream of the electrolysis cells in view of the fact that such metals which accumulate can act as decomposition catalysts for hydrogen peroxide which is produced in the hydrolysis stage of the process.

While this invention has been described with reference to certain specific embodiments, it will be recognized by those skilled in this art that many variations are possible without departing from the scope and spirit of the invention, and it will be understood that it is intended to cover all changes and modifications of the invention disclosed herein for the purpose of illustration which do not constitute departures from the spirit and scope of the invention.

What is claimed is:

1. A bipolar electrode comprising a valve metal anode substrate having on a side of such substrate a strip of a platinum group metal, wherein said bipolar electrode comprises a cathode sheet and said valve metal anode substrate comprises strips of a platinum group metal and said anode is separated from said cathode sheet by an electrically conductive adhesive composition and wherein a width of said platinum group metal strips is twice the distance between said strips.

2. The electrode of claim 1 wherein said valve metal is selected from the group consisting of titanium, niobium, and zirconium.

3. The electrode of claim 2 wherein said platinum group metal is platinum, said cathode comprises a stainless steel, and said electrically conductive adhesive composition comprises a mixture of an elastomer modified vinyl ester polymer and a graphite powder.

4. A bipolar electrode comprising a valve metal anode substrate having on a side of said substrate a strip of a platinum group metal wherein said bipolar electrode comprises a cathode sheet and said valve metal anode substrate comprises strips of a platinum group metal having a width which is twice a distance between said strips and said anode is separated from said cathode sheet by an electrically conductive adhesive composition wherein said cathode sheet comprises a stainless steel and wherein said bipolar electrode additionally comprises an anode current collector and a cathode current collector and wherein said valve metal anode comprises titanium and strips of platinum having a width which is twice a distance between said strips.

5. The bipolar electrode of claim 4 wherein said stainless steel cathode comprises about 20 to about 30 weight percent nickel, about 15 to about 25 weight percent chromium, and about 5 to about 7 weight percent molybdenum.

6. The bipolar electrode of claim 5 wherein said anode and said cathode are connected, respectively, by spacers to said anode current collector and said cathode current collector, said anode current collector comprising a valve metal and said cathode current collector comprising a stainless steel.

7. The bipolar electrode of claim 6 wherein said electrically conductive adhesive composition comprises a mixture of an elastomer modified vinyl ester polymer and a graphite powder.

* * * * *